US005908170A

United States Patent [19]

Kunz

[11] Patent Number: 5,908,170

[45] Date of Patent: Jun. 1, 1999

[54] DEVICE FOR WINDING A YARN ONTO A BOBBIN

[75] Inventor: Lukas Kunz, Küsnacht, Switzerland

[73] Assignee: Scharer Schweiter Mettler AG, Horgen, Switzerland

[21] Appl. No.: 08/957,946

[22] Filed: Oct. 27, 1997

[30] Foreign Application Priority Data

Oct. 28, 1996 [EP] European Pat. Off. ..... 96117256

[51] Int. Cl.[6] ..... B65H 54/28; B65H 54/38

[52] U.S. Cl. ..... 242/477.3; 242/480.8; 242/483.9

[58] Field of Search ..... 242/477.1, 477.3, 242/480.8, 478.2, 480.9, 483.9

[56] References Cited

U.S. PATENT DOCUMENTS

| | | | |
|---|---|---|---|
| 2,246,465 | 6/1941 | Helm | 242/477.3 |
| 2,869,797 | 1/1959 | Clerc | 242/477.3 |
| 3,656,291 | 4/1972 | Key et al. | 242/477.3 X |
| 4,515,320 | 5/1985 | Slavik et al. | 242/478.2 |
| 4,973,007 | 11/1990 | Schippers et al. | 242/477.1 |

FOREIGN PATENT DOCUMENTS

| | | |
|---|---|---|
| 0302461 | 2/1989 | European Pat. Off. . |
| 1131575 | 6/1962 | Germany . |
| 3907125 | 9/1989 | Germany . |
| 153167 | 3/1932 | Switzerland . |
| 9208664 | 5/1992 | WIPO . |

*Primary Examiner*—Michael Mansen
*Attorney, Agent, or Firm*—Baker & Botts L.L.P.

[57] ABSTRACT

An apparatus for winding a yarn onto a bobbin wherein the apparatus includes: a finger-shaped yarn guide supported along a first axis orientated at right angles to the bobbin axis, the yarn guide being subject to an oscillating motion about the first axis; and energy storage mechanisms for controlling the deceleration and acceleration of the yarn guide in short regions near reversing points for the yarn guide motion, wherein the position of the energy storage mechanisms is adjustable.

13 Claims, 3 Drawing Sheets

DEVICE FOR WINDING A YARN ONTO A BOBBIN

BACKGROUND OF THE INVENTION

The present invention relates to an apparatus for winding a yarn onto a bobbin. The apparatus includes a yam guide, which is driven in an oscillating manner, and energy storage mechanisms for controlling the deceleration and acceleration of the yarn guide during the reversal of its motion.

Generally, two types of yarn guides are used in conventional winding devices—those that take the form of driving means such as a belt, cable or string orientated in a plane parallel to the bobbin axis, and those which are driven about an axis disposed at right angles to the bobbin axis and resemble a finger or pointer. In the case of the latter, the yarn guide may be driven only relatively slowly and may be used only for winding parallel-wound bobbins, but under no circumstances for cross-wound bobbins. Generally, no energy storage mechanisms are used on account of the low speed of the yarn guides.

Energy storage mechanisms may be used with drivable yarn guides that reciprocate motion parallel to the bobbin axis. These mechanisms may take the form of spring/damper systems, the spring of which is practically loaded and unloaded in each case over a displacement length, thereby limiting the speed of the yarn guides. The energy storage mechanisms are moreover disposed in a stationary manner so that each variation of the yarn guide displacement requires a corresponding adaptation of the position of the energy storage mechanisms.

Therefore, an object of the present invention is to provide a winding device which permits high accelerations of the yam guide at the reversing points and offers the greatest possible adaptability of the structure of the winding device. A further object of the present invention is to provide a inexpensive yarn guide and drive that requires little maintenance.

SUMMARY OF THE INVENTION

The apparatus of the present invention includes: a finger-like yarn guide that is supported along an axis orientated at right angles to the bobbin axis, and energy storage mechanisms for controlling the deceleration and acceleration of the yarn guide in a short region of motion around the reversing points, wherein the position of the energy storage mechanisms is adjustable. The finger-like yarn guide of the present invention is inexpensive and very easily adaptable to varying bobbin parameters. Because the deceleration and acceleration of the yarn guide is controlled in a short region, the yarn guide can be operated at a significantly higher speeds. The adjustability of the position of the energy storage mechanisms allows variations in the yarn guide without major mechanical intervention.

According to an aspect of the present invention, the winding device of the present invention is characterized in that from the start of deceleration of the yarn guide up to each reversing point, the kinetic energy of the yarn guide is converted into potential energy. After attainment of each reversing point, the potential energy is returned to the yarn guide.

According to another aspect of the present invention, the winding device is characterized in that the energy storage mechanisms are fastened on a carrier which oscillates about the axis orientated at right angles to the bobbin axis.

According to a yet another aspect of the present invention, adjustment of the position of the energy storage mechanisms is effected by varying the amplitude of the motion of the carrier.

By virtue of fastening the energy storage mechanisms on the carrier, the controlling range of the deceleration and acceleration of the yarn guide may be adjusted precisely and easily. Adjusting the position of the energy storage mechanisms by means of a simple intervention in the geometry of motion of the carrier increases the adaptability of the device to a quite extraordinary extent.

BRIEF DESCRIPTION OF THE DRAWINGS

For a complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
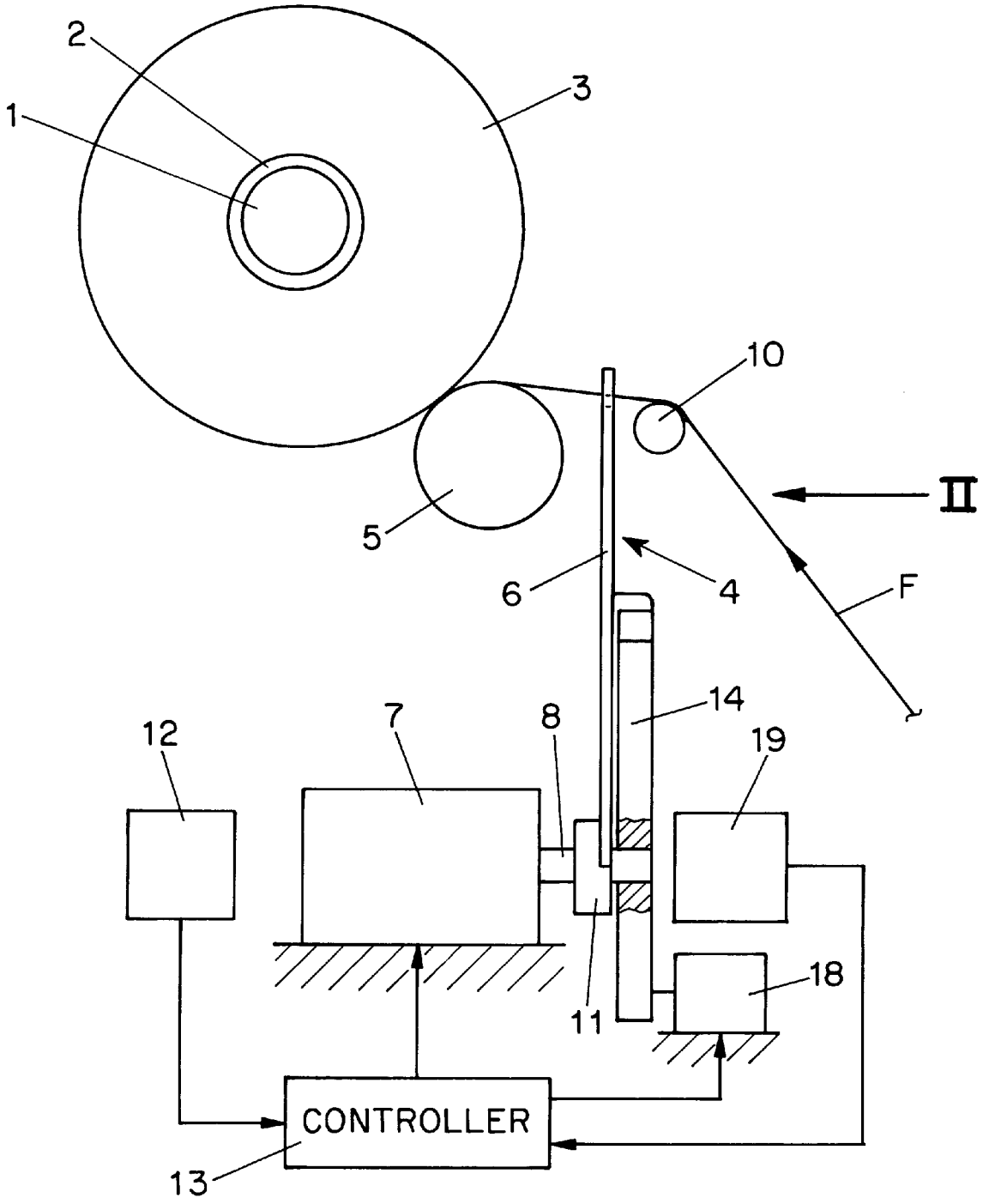
FIGS. 1 and 1A illustrate a winding head of a bobbin winding machine in a direction parallel to the bobbin axis.
Figure 2:
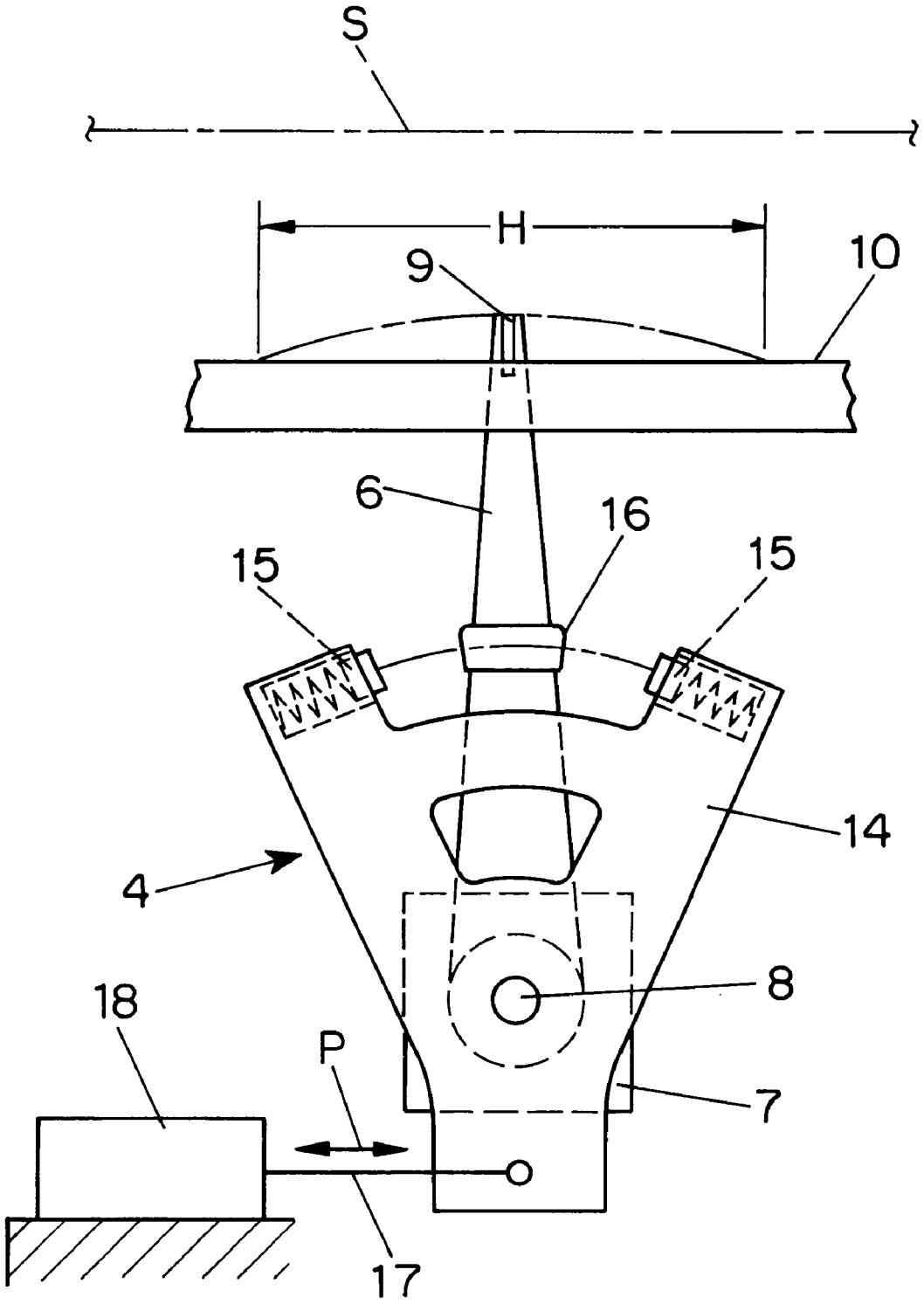
FIG. 2 is a view of the present invention in the direction of the arrow II of FIG. 1.

FIGS. 1 and 2 show a side view and front view, respectively, of a winding head that substantially includes: a motor-actuated spindle 1 for receiving a bobbin case 2, onto which a bobbin 3, e.g., a cross-wound bobbin, is wound, and a yarn displacement device 4 for displacing a yarn F that is drawn off a supply coil (not shown). In FIG. 2, spindle 1, bobbin case 2 and bobbin 3 are not shown and are instead indicated by a dash-dot line S symbolizing the axis of the bobbin 3. The bobbin 3 is applied along a surface line against a freely rotatable roller 5, which is mounted on a suitable carrier part of the bobbin winding machine.

The yarn displacement device 4 used to produce the desired winding has, as its central element, a finger or pointer shaped yarn guide 6 which is mounted on a shaft 8 driven by a motor 7. The shaft 8 is orientated at right angles to the bobbin axis S and at right angles to the drawing plane, whereby the yarn guide 6 during operation of the winding head executes an oscillating motion in the plane at right angles to the shaft 8. The yarn guide 6 is further provided at one free end with a longitudinal slot 9 through which the yarn F passes.

A guide rail 10, around which the yarn F is partially wrapped, is disposed upstream of the yarn guide 6 in the running direction of the yarn F. As shown in FIGS. 1 and 2, the yarn F runs from the supply coil (not shown) to the guide rail 10 and through the slot 9 of the yarn guide 6 to the roller 5. The relative positions of the yarn guide 6 and the guide rail 10, including the length of the longitudinal slot 9, are selected such that the yarn F does not touch the bottom of the longitudinal slot 9 while the yarn guide 6 is in motion. This configuration thereby guarantees that the yarn path from the guide rail 10 to the bobbin 3 always has the same geometry which, on account of the roller 5, is also independent of the diameter of the bobbin 3.

As further shown in FIG. 1, the finger/pointer-shaped yarn guide 6 is fastened to a hub 11 located on the shaft 8 of the motor 7. During operation of the motor 7, depending on its direction of rotation, the yarn guide 6 is swivelled side-to-side in either direction. The maximum displacement caused by the swivelling motion is denoted in FIG. 2 by the reference character H. On account of the guide rail 10, the yarn F during the swivelling motion of the yarn guide 6 is always moved parallel to the bobbin axis S, and the so-called trailing length, i.e., the yarn length from the yarn guide 6 to the bobbin 3, is always held at a constant length. The inertia of the motor 7 is adapted to the inertia of the load formed by the hub 11, the yarn guide 6 and the yarn F in such a way that optimum efficiency is achieved.

Figure 1A:
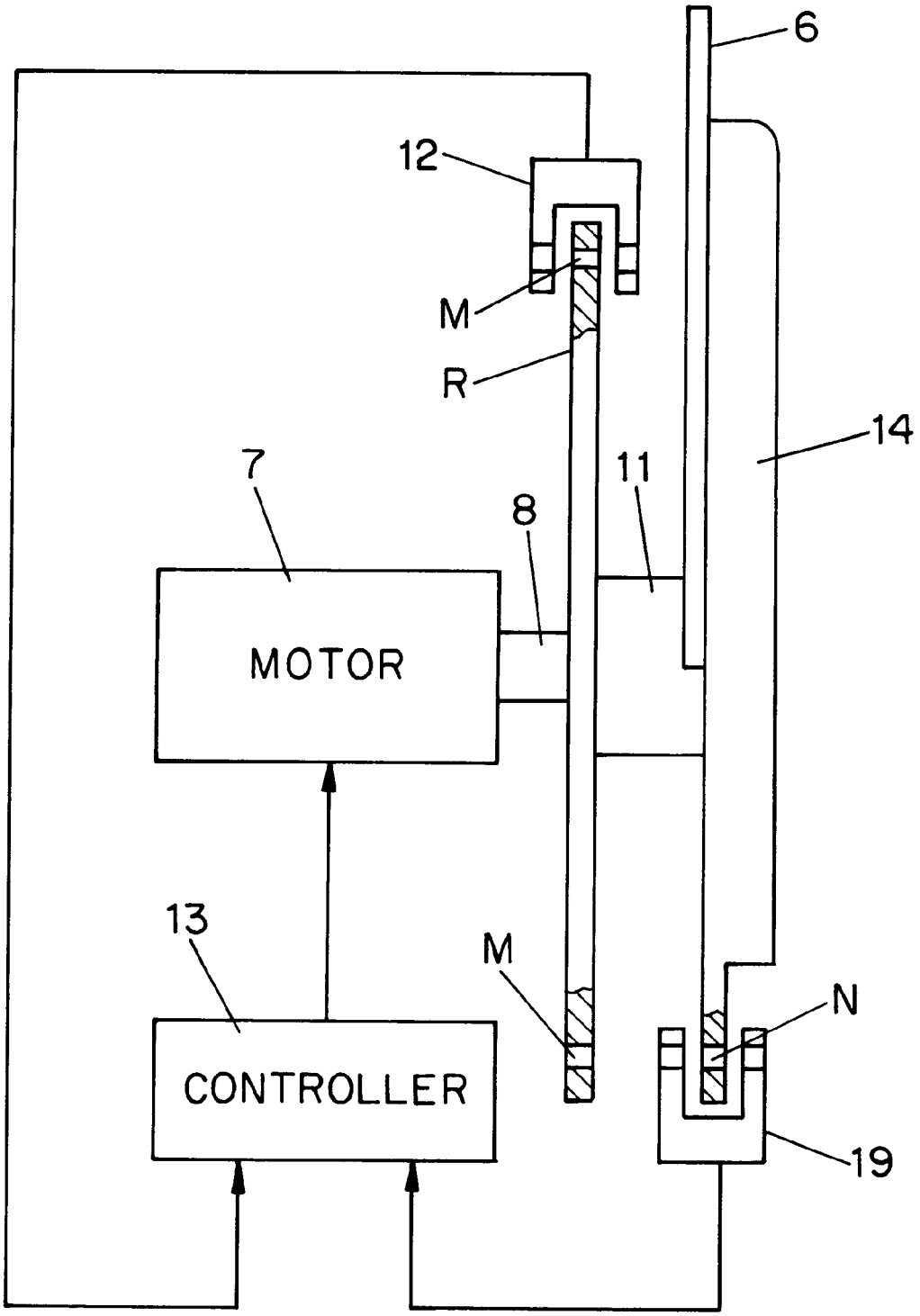

Associated with the motor 7 is a first sensor 12 for detecting the angular position of the hub 11 and hence the traverse position of the yarn guide 6. The first sensor 12 is a photo-electric sensor, which comprises a transmitting diode and a receiving diode (not shown), which senses the rotation of a disc rigidly connected to the hub 11. For this purpose, the disc is provided with suitable optically scannable markings, e.g., with holes or slots, disposed along a circular arc. The number of markings on the disc and their dimensions are selected such that for each displacement of the yarn guide 6 there are enough positions of the yarn guide 6 detectable by the first sensor 12 as required to produce neat, closed precision windings. A preferred embodiment of the invention, including the first sensor 12, disc R and scan markings M, is shown in FIG. 1A.

The first sensor 12 further generates a signal that is provided to a controller 13, which determines whether the yarn guide 6 at a specific instant is situated at its setpoint position. In the event of deviations between actual and setpoint values, the controller 13 supplies a corresponding control signal to the motor 7.

The first sensor 12 refers its monitoring always to an initial position of the yarn guide 6, preferably to the zero point of its swivelling motion. Calibration of the first sensor 12 is effected by moving the yarn guide 6 first to one reversing point, and then to the other reversing point, wherein the first sensor 12 counts the number of markings corresponding to said displacement and calculates the-zero point. The sensor 12 therefore knows the number of scanning pulses between the zero point and the reversing points so that, with the aid of said scanning pulses, the position of the yarn guide 6 corresponding to a specific scanning pulse may be determined at any time. Consequently, extremely precise control of the motor 7 is achievable thereby allowing optimum utilization of the motor output.

A further task of the controller 13 is to linearize the sinusoidal transfer speed of the yarn F. "Sinusoidal" in the present context means that the yarn F is moving faster in the middle of the displacement motion than at the reversing points. The controller 13 therefore compensates for this difference by offsetting the linear setpoint values of the yarn guide 6 position with a sine function.

As shown in FIG. 2, provided in the region of the reversing points of the yarn guide 6 are energy storage mechanisms for controlling the deceleration and acceleration of the yarn guide 6 during reversal of its motion. From the start of deceleration, the respective energy storage mechanism converts the kinetic energy of the yarn guide 6 into potential energy, thereby decelerating the yarn guide. At the end of deceleration, as soon as a reversing point has been reached, the stored energy is returned to the moving system thus accelerating the yarn guide 6 once again. Theoretically (ignoring friction), the yarn guide 6 is accelerated back up to its original speed without additional energy being expended.

The energy storage mechanisms of the present invention are formed by elastic or spring storage elements 15, such as air buffers, magnetic buffers, spring-mounted buffer plates or other suitable storage media, which are mounted on a carrier 14. At the level of the storage elements 15, the yarn guide 6 has a rib-like projection 16 which encounters and loads the storage element 15 the instant deceleration begins. Acceleration begins after the yarn guide 6 reaches a reversing point, i.e., the storage element 15 is unloaded thereby accelerating the yarn guide 6.

Since the characteristic curve of the motor 7 is known, the drive of the yarn guide 6 may be set in such a way that the respective storage element 15, at the instant when deceleration begins, is positioned at each reversing point. Since it is precisely at said instant that the motor 7 starts to brake, two braking torques are effective, the braking torque of the energy storage mechanism and the braking torque of the motor 7. The reverse is true of the acceleration phase.

The length of the section over which the energy storage mechanism is loaded depends upon the reversing displacement, which in turn determines the bobbin quality. It is important that the yarn remain for the same length of time at each point of the bobbin and also not for a longer time at the ends of the bobbin because, otherwise, edge zones develop and become too thick. In practice, the length of the section over which the energy storage mechanism is loaded is around 1 mm.

As shown in FIG. 2, the carrier 14 of the storage elements 15 is substantially Y-shaped. This should not however be interpreted as restrictive. Rather, the shape of the carrier 14 is selectable from a wide variety of shapes and may, for example, be circular or fork-shaped. The carrier 14, which is mounted in a freely rotatable manner on the shaft 8 of the motor 7, supports the storage elements 15 at the ends of its two upward-projecting limbs and is connected by a connecting element 17 to a drive 18 at its downward-projecting limb. During operation of the drive 18, the connecting element 17 executes a reciprocating motion in the direction of the illustrated double arrow P, with the result being that the carrier 14 is driven in an oscillating manner about the shaft 8. The magnitude of the displacement caused by the oscillating motion of the carrier 14 may be adjusted at the drive 18 or at the connecting element 17 using suitable means, e.g., a stepping motor or any linear or circular drive. When the adjusting means are electrical or magnetic and reproducible, any desired displacement profile may be preselected for the winding process.

Consequently, the displacing motion of the carrier 14 defines the displacement of the yarn guide 6, wherein the carrier 14 executes a much shorter displacement motion and hence is also driven much more slowly than the yarn guide 6. Conceivably, the carrier 14 could remain in its initial position as shown in FIG. 2 if the distance between the storage elements 15 is set precisely large enough for the projection 16 of the yarn guide 6 to encounter the storage elements 15 at the very instant when deceleration begins.

When the displacement of the yarn guide 6 is to be longer, the carrier 14 with the storage elements 15 would then have to be swivelled in each case slightly outwards and, when the displacement of the yarn guide 6 is to be shorter, said carrier 14 would have to be swivelled in each case slightly inwards. The displacement of the carrier 14 is therefore always very short compared to the displacement of the yarn guide 6. Nominally, the displacing motion of the carrier corresponds to a difference between the displacement of the yarn guide and an initial position of the energy storage mechanisms, and is represented by a positive value when the carrier is driven in a same direction as the yarn guide motion, and by a negative value when driven in a direction opposite to the yarn guide motion.

For monitoring and controlling the motion of the carrier 14, a second sensor 19 is provided which, like the first sensor 12, is connected to the controller 13. The second sensor 19 is a position sensor, e.g., a photoelectric sensor, which is capable of sensing the rotation of the carrier 14. Accordingly, the carrier 14 is provided with suitable optically scannable markings, e.g. holes or slots, which are detectable by the second sensor 19. A preferred embodiment of the invention, including the first sensor 19 and scan markings N, is shown in FIG. 1A.

The second sensor 19 generates a signal that is provided to the controller 13, which determines whether the carrier 14 at a specific instant is situated in its setpoint position. In the event of a deviation between actual and setpoint values, the controller 13 supplies a corresponding signal to the drive 18 so that the carrier 14 is decelerated or accelerated. Since the signals of both the first sensor 12 and the second sensor 19 are supplied to the controller 13, the controller 13 performs a cross-comparison between the two sensor signals. Consequently, it is possible to detect any deviations in the synchronism between the swivelling motions of the yarn guide 6 and the carrier 14. Deviations are then compensated for by re-adjusting the motor 7 and drive 18 as required.

The aforementioned yarn displacement device 4 has the advantage of achieving a high winding speed and high acceleration of the yarn guide 6 at the reversing points. By virtue of the energy storage mechanisms 15 acting during the deceleration and acceleration phases in the region of the reversing points, a relatively large amount of energy can be recovered during deceleration and used subsequently for acceleration, thereby resulting in lower energy consumption by the yarn displacement device 4.

The adjustability of the energy storage mechanisms 15 makes it easy to vary the displacement of the yarn guide 6 and the arrangement of the energy storage mechanisms 15 on the carrier 14. By driving the carrier 14 in an oscillating manner, the displacement of the yarn guide 6 is varied simply by varying the displacement of the carrier 14. The displacement of the yarn guide 6 is thereby varied without mechanically adjusting the position of the energy storage mechanisms 15. By adjusting the displacement of the carrier 14 through electrical or magnetic and reproducible means, it is possible to produce bobbins wound in any desired manner.

Although the present invention has been described in connection with particular embodiments thereof, it is to be understood that such embodiments are susceptible of modification and variation without departing from the inventive concept disclosed. All such modifications and variations, therefore, are intended to be included within the spirit and scope of the appended claims.

I claim:

1. An apparatus for winding a yarn onto a bobbin, said apparatus comprising:

a yarn guide supported along a first axis orientated at right angles to the bobbin axis and subject to a first oscillating displacement motion;

a motor coupled to said yarn guide for applying said first oscillating displacement force to said yarn guide and positioning said yarn guide between corresponding reversing points; and position controllable energy storage mechanisms detached from said yarn guide for controlling the deceleration and acceleration of said yarn guide during reversal of motion thereof in a short region proximal to each of said reversing points, wherein the position of said energy storage mechanisms with respect to said yarn guide is controllable during operation of said apparatus.

2. The apparatus according to claim 1, wherein said energy storage mechanisms convert the kinetic energy of said yarn guide generated from the start of said deceleration through each of said reversing points into potential energy, and then transfer said potential energy back to said yarn guide after said yarn guide reaches each of said reversing points.

3. The apparatus according to claim 1, wherein said yarn guide is finger-shaped, comprising an elongated slot connected at one end of said yarn guide, said elongated slot being orientated at right angles to said bobbin axis in which said yarn passes.

4. The apparatus according to claim 3, further comprising a guide rail for guiding said yarn, wherein said guide rail is disposed on a side of said yarn guide facing away from said bobbin and along a running direction for said yarn, and wherein said slot and said guide rail are constructed and arranged to maintain the portion of said yarn extending between said yarn guide and said bobbin at a constant length.

5. The apparatus according to claim 1, further comprising a carrier for supporting said energy storage mechanisms and a drive coupled to said carrier for applying a second oscillating displacement force to said carrier and positioning said energy storage mechanisms with respect to said yarn guide.

6. The apparatus according to claim 5, wherein the position of said energy storage mechanisms is adjusted by varying said motion of said carrier.

7. The apparatus according to claim 5, wherein:

said energy storage mechanisms are spring-like elements disposed on said carrier at a predetermined distance;

and the motion of said carrier corresponds to a difference between the displacement of said yarn guide and an initial position of said energy storage mechanisms, and is represented by a positive value when said carrier is driven in a same direction as said yarn guide motion, and by a negative value when driven in a direction opposite to said yarn guide motion.

8. The apparatus according to claim 1, further comprising:

a first sensor for monitoring the motion of said yarn guide; and a controller coupled to said first sensor for controlling said motor so as to correct deviations between an actual speed profile and a setpoint speed profile of said yarn guide.

9. The apparatus according to claim 8, wherein said yarn has a sinusoidal transfer speed that is linearized by said controller.

10. The apparatus according to claim 8, wherein said apparatus further comprises a carrier coupled to said controller for supporting said energy storage mechanisms and wherein said controller monitors and synchronizes the motion of said yarn guide and said carrier.

11. The apparatus according to claim 10, further comprising a second sensor connected to said controller for monitoring the motion of said carrier, wherein said controller compensates for the deviations between said actual and setpoint speed profiles of said carrier.

12. The apparatus according to claim 11, wherein:

said first and second sensors are position sensors; and said apparatus further comprises scan markings located on said yarn guide and said carrier.

13. The apparatus according to claim 12, wherein said scan markings are located on elements coupled to said yarn guide and said carrier.

* * * * *

UNITED STATES PATENT AND TRADEMARK OFFICE

CERTIFICATE OF CORRECTION

PATENT NO. : 5,908,170

DATED : June 1, 1999

INVENTOR(S) : Lukas Kunz

It is certified that error appears in the above-identified patent and that said Letters Patent is hereby corrected as shown below:

Title page, Item [54] and col. 1,
Title: "DEVICE FOR WINDING A YARN ONTO A BOBBIN" should read --APPARATUS FOR WINDING A YARN ONTO A BOBBIN--;

Col. 1, line 34: "a" should read --an--.

Signed and Sealed this

Twenty-third Day of January, 2001

*Attest:*

*Attesting Officer*

Q. TODD DICKINSON

*Commissioner of Patents and Trademarks*